United States Patent [19]

Kershner

[11] Patent Number: 4,808,129

[45] Date of Patent: Feb. 28, 1989

[54] CONTACT FOR STRIP LINE SWITCH

[76] Inventor: Stephen W. Kershner, 6667 Van Winkle Dr., Falls Church, Va. 22044

[21] Appl. No.: 154,262

[22] Filed: Feb. 10, 1988

[51] Int. Cl.[4] ..... H01R 13/11

[52] U.S. Cl. ..... 439/856; 439/861

[58] Field of Search ..... 439/816, 842, 856, 861, 439/862

[56] References Cited

U.S. PATENT DOCUMENTS

| | | | |
|---|---|---|---|
| 2,120,396 | 6/1938 | Domaleski | 439/861 |
| 2,391,479 | 12/1945 | Rivers | 439/856 |
| 2,917,612 | 12/1959 | Chabot | 439/861 |

*Primary Examiner*—Joseph H. McGlynn

[57] ABSTRACT

A cantilever contact is disclosed of the type adapted to be incorporated into a switch system or array, which comprises at least a strip line comprising a plurality of like cantilever contacts arranged in end-to-end, overlapping relationship with each other. The strip line of such contacts is adapted to be connected to a transmission system, which has a characteristic impedance. The cantilever contact includes first and second ends, a first portion adjacent to the first end affixed to a support member, a second spring portion disposed intermediate to the first and second ends, a third contact portion disposed adjacent to the first affixed portion and on the other side of the first affixed portion with respect to the second spring portion, and a fourth contact portion disposed adjacent to the second end and freely suspended by the second spring portion with respect to the support member for contacting a third contact portion of an adjacent contact in the strip line. Each of the first and second ends of each contact is folded back upon itself such that its end is shielded from the adjacent contact and, instead, a rounded surface is presented thereto. Each cantilever contact has at least one bifurcating slot disposed longitudinally thereof and is dimensioned to ensure the longitudinal flexibility of the contact. In addition, each cantilever contact has at least a further bifurcating slot disposed longitudinally thereof and extending from the second end towards the first end a length selected such that the strip line of contacts has an aggregate impedance set to be substantially equal to the characteristic impedance.

14 Claims, 1 Drawing Sheet

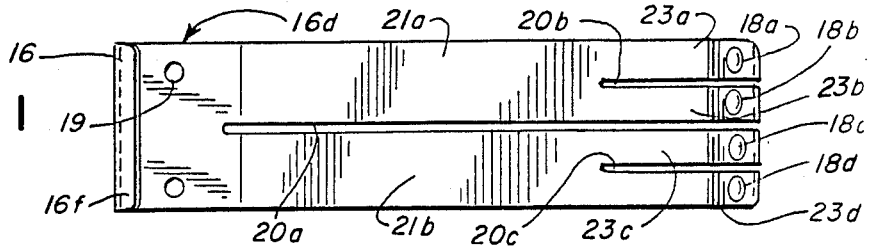
FIG. 1
FIG. 2
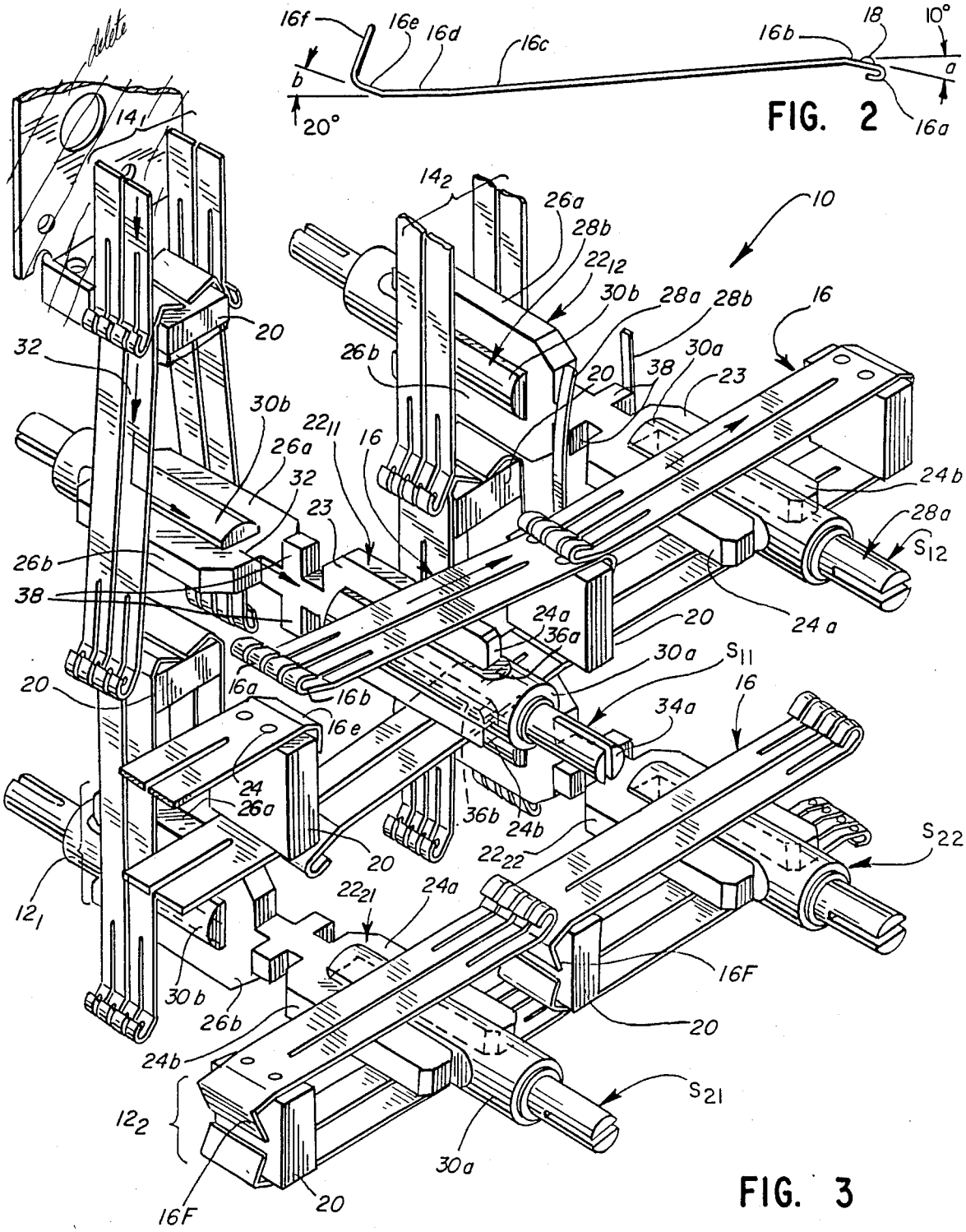
FIG. 3

CONTACT FOR STRIP LINE SWITCH

FIELD OF THE INVENTION

This invention relates to an array of strip line switches and, in particular, to an improved contact therefore, whereby the electrical characteristics of the array are improved.

DESCRIPTION OF THE PRIOR ART

U.S. Pat. No. 3,666,902 of Owen et al., assigned to the assignee of this invention, discloses an array of strip line switches for selectively coupling any of a number of transmitters to any of a number of antennas. The contemplated transmitters are of the RF type. The antennas are typically directional in their transmitting pattern. Thus, to transmit a particular message to a selected receiver or receivers, it may be necessary to connect a particular transmitter to one of a number of antennas as would enable the transmission to the selected receiver(s). The switch array disclosed by Owen et al. comprises an array of strip line switches disposed in rows and columns, which are oriented orthogonally with respect to each other. Each of the strip line switches comprises a pair of flexible cantilever contacts disposed in a spaced, substantially parallel relationship with each other. One end of each cantilever contact is fixedly supported in a spaced relationship from the fixed end of the other cantilever contact by an insulating support block. The other end of each cantilever contact is free. A rotor is associated with each pair of cantilever contacts and serves to dispose the free ends of a pair of cantilever contacts from a rest position to a separated position. Each such strip line switch is disposed as its name implies in a line, which forms either a column or row of this switch array. Adjacent switches in a strip line are disposed such that the free ends of a pair of the cantilever contacts are disposed to contact the fixed ends of the contacts of the next switch in that row or column, when the cantilever contacts are in their rest position.

The rows and columns of the switch array as disclosed in the Owen et al. patent '902 intersect at a plurality of points. One of a plurality of rotors is disposed at each point of the array. Each rotor has a first set of spline cams adapted to open the flexible cantilever contacts which are disposed in a row, and a second set of spline cams disposed orthogonally with respect to the first set of spline cams for actuating and opening the cantilever contacts of the column which intersects that row. The rotor is normally disposed in its through position, wherein its splines do not engage the contacts of either the row or the column; thus, the cantilever contacts of each strip line switch as disposed in both the row and column, are normally in their rest position and contact the next switch in its line. When it is desired to connect a selected transmitter, which is coupled to a particular column of strip line switches, to a selected antenna, which is coupled to a particular row, the rotor disposed at the intersection of that row and that column is rotated 90°, whereby its first and second sets of spline cams engage and separate the cantilever contacts of its switches, thereby disconnecting each switch from the next switch in its row and column. Each such rotor is made of an electrically conductive material such that the signal as transmitted from a particular transmitter along that row of switches is coupled by the rotor to that switch and its line of switches in that particular column, whereby a selected transmitter is coupled to a selected antenna.

The switch array of the Owen et al. patent '902 was adapted to be coupled with transmitters operating at a power output of up to 20 kilowatts average, 100 kilowatts peak into a 50 ohm characteristic impedance system and with a carrier frequency of from DC to 32 MHz. As the peak power applied to the switches of such an array is increased to the order of 400 Kilowatts, arcing or corona discharge becomes a problem. Further, in order to decrease the power loss presented by such a switch array, there needs to be a precise impedance match between the characteristic impedance o the transmission line system and that impedance presented by a line (column or row) of the strip line switches. In this regard, as the frequency of the signal applied to the switch array increases, the capacitive and inductive components of such impedance become significant.

U.S. Pat. No. 3,102,161 of Raisbeck discloses a theoretical teaching of the desirability of configuring, at least generally, the surfaces of a contact to reduce corona discharge or arcing. U.S. Pat. No. 1,667,652 of Case and U.S. Pat. No. 3,858,019 of Murri et al. show contacts which are rounded. The Case patent '652 discloses a switch element in the form of a finger 10, which has one end fixedly mounted to a support 14 and the other end being flexibly disposed to make contact with a segment 19. The flexible end is bent back upon itself to provide a rounded contact surface 15, which makes electrical contact with the segment 19. These contacts are subjected to severe wear from abrasion and arcing. The Murri et al. patent '019 discloses a blade 35, which is suspended for alternately making contact with element 21 or element 44. The free end of the blade 35 has a rounded contact portion 41 for making contact with the element 44 and a second rounded contact portion 42 for making contact with the element 21.

U.S. Pat. No. 3,900,711 of Holland discloses a switch 18 comprised of a movable contact member 96, which is bifurcated into four distinct contact elements. In operation, a cam drum 26 (see FIG. 6) causes a coupling element 106 to move the contact member 96 from a closed position, wherein its distal end makes contact with fixed contacts 92 and 94, and a circuit is completed therebetween through the contact member 96. When rotated, the cam drum 26 causes the contact member 96 to move upward, thus breaking the circuit between the contacts 92 and 96. Current flows through leg portions 112 and 114 (see FIG. 7) of the contact member 96 in opposite directions with each other, whereby magnetic fields are induced as would tend to cancel each other and thereby reduce the inductance of the movable contact 96. As will be detailed below, such operation contrasts to this invention, wherein currents flow in the same direction in a contact and serve to increase the contact's inductance. The contact member 96 of Holland is bifurcated into four distinct contact elements. U.S. Pat. No. 2,312,902 of Hickman et al. discloses a relay having a bifurcated element 37, whose free end has three slots 41, 42 and 43.

SUMMARY OF THE INVENTION

It is therefore an object of this invention to provide a new and improved flexible cantilever contact for a strip line switch, which reduces the possibility of corona or arcing between the various elements of an array of such switches.

It is a further object of this invention to provide a new and improved contact element for an array of strip line switches, which are configured to increase the inductance thereof whereby a line of such switches presents a selected impedance.

In accordance with these and other objects of this invention, there is disclosed a contact to be incorporated into a switch system or array comprising at least one strip line, which comprises a plurality of like contacts arranged in an end-to-end, overlapping relationship with each other. The strip line is adapted to be coupled to a signal generator or transmission system, which output signals illustratively in the RF range and has a characteristic impedance. Each contact is adapted to be mounted upon a support member and comprises a first trailing end and a second leading end, a first portion adjacent to the first end affixed to the support member, a second spring portion disposed intermediate the first and second ends, a third contact portion disposed adjacent to the first fixed portion and on the other side of the first fixed portion with respect to the second spring portion, and a fourth contact portion disposed adjacent to the second end and freely suspended with respect to the support member by the second spring portion for contacting a third contact portion of an adjacent contact in the strip line. The first and second ends of each contact of the strip line include respectively fifth and sixth protective portions, which are each configured to present a rounded surface and are folded back upon themselves with respect to a second end and a first end of those contacts as disposed on either side of that contact, whereby corona from the first and second ends or arcing between adjacent separated contacts within a strip line are significantly reduced.

In a further object of this invention, each contact further has a bifurcating slot, which is disposed longitudinally thereof and extends from the second end towards the first end. The bifurcating slot is so dimensioned that the strip line of like contacts presents an impedance to the transmission system set substantially equal to its characteristic impedance.

In a still further aspect of this invention, a second slot is disposed centrally and longitudinally along the contact to provide first and second fingers; the centrally disposed slot extends along a significant length of the contact to enhance the flexibility of the resulting first and second fingers. Further, the first mentioned and a third bifurcating slot are disposed on either side of the centrally disposed, second slot and extend from the first end towards the second end to provide third and fourth fingers. The lengths of the first mentioned and third slots are less than that of the second slot and are selected primarily to ensure the rigidity of the first, second, third and fourth fingers, and secondarily to impart a selected impedance to its contact, whereby a strip line of such contacts has an impedance selected to match the characteristic impedance of the transmission system coupled to that strip line.

BRIEF DESCRIPTION OF THE DRAWINGS

Other objects and advantages of the present invention will become apparent from the following detailed description of a preferred embodiment thereof and from the attached drawings in which:

FIG. 1 is a top plan view of the improved flexible cantilever contact of this invention;

FIG. 2 is a side view of the cantilever contact shown in FIG. 1; and

FIG. 3 is a perspective view of an array of strip line switches, each of which includes the improved flexible cantilever contact as shown in FIGS. 1 and 2.

DESCRIPTION OF A PREFERRED EMBODIMENT

Referring now to the drawings and in particular to FIG. 3, there is shown a switch array 10, which is comprised of a plurality of strip line switches S. Each such switch S is disposed at one of a plurality of points of intersection between a first plurality of vertically extending columns $\mathbf{14}_1$, $\mathbf{14}_2$-$\mathbf{14}_n$, and a second plurality of rows $\mathbf{12}_1$, $\mathbf{12}_2$-$\mathbf{12}_m$. Each column 14 and row 12 comprises a strip line formed by a plurality of serially connectable switches S; each switch S comprises a pair of cantilever contacts 16. When a pair of the flexible cantilever contacts 16 are in their normal position, that pair of contacts 16 makes electrical contact with the next, successive pair of contacts in that line, i.e., in its column 14 or in its row 12. In an illustrative embodiment of this invention, each column 14 of switches is coupled to a discrete transmitter or signal generator (not shown) of RF signals to be broadcast or transmitted. The strip line of the switches S in each row 12 is illustratively coupled to an antenna (not shown) having a particular broadcast or radiating pattern. It is alternately understood that each column 14 may be coupled to an antenna, and that each row 12 may be coupled to a transmitter. At the point of intersection of each column 14 and each row 12, there is disposed a rotor 22, which serves to dispose each pair of its contacts 16 as disposed in its column 14 and its row 12 from its normally closed or rest position to a separated position, whereby the circuit as would normally be formed by the strip line of the closed switches S is interrupted and a current path or circuit, which is shown in FIG. 3 as a series of arrows and marked with the numeral 32, is established between a selected transmitter and a selected antenna dependent upon which rotor 22 is actuated.

As shown in FIGS. 1 and 2, each cantilever contact 16 has a first, protective end **16*f*, a first contact portion 16*e*, an affixed portion 16*d*, a spring portion 16*c*, a second contact portion 16*b* bearing a plurality of dimples 18 and terminating in a second protective free, rounded end 16*a*. The first contact portions 16*e* of one pair of cantilever contacts 16 are adapted to mate with the contact portions 16*b* of the next or adjacent pair of cantilever contacts 16. The first protective end 16*f* is bent backward upon itself and extends away from the affixed portion 16*d* and the spring portion 16*c* of the cantilever contact 16. In an illustrative embodiment of this invention, each of the cantilever contacts 16 is made of a beryllium copper, which is plated with a 0.0005 inch thick layer of silver to improve the conductivity of the contact 16. As shown in FIG. 3, each of the portions 16*d* of a pair of the cantilever contacts 16 is affixedly mounted upon opposing surfaces of a conductive support block 20 by suitable fasteners such as a pair of screws 24. In an illustrative embodiment of this invention, the support block 20 is made of brass with a 0.0005 inch thick layer of silver plated there upon. The support block 20 thus serves to dispose each of the cantilever contacts 16 supported thereon at the same voltage potential and, further, helps to dissipate the high temperatures generated by the relatively large current flows thereto, thus providing an increased mechanical stability as compared to a support block made of an insulating material. In addition, the screws 24 seat securely within a support block 20 made of such a metallic material. Each cantilever contact 16 is mounted by its support block 20 to lie in its normal or rest position in a parallel relationship to the other contact 16 of the pair. In such rest position, the second contact portion 16*b* is flexibly disposed and contacts the first contact portion 16*e* of the next or adjacent pair of cantilever contacts 16, whereby an electrical circuit or line is completed from one pair of the cantilever contacts 16** to the next.

As shown in FIG. 3, each of the rotors 22 is disposed at the point of intersection at the columns 14 and the rows 12. Particularly referring to the rotor $22_{11}$, each rotor 22 comprises an electrically conductive member 23, which is made of phosphorous bronze in an illustrative embodiment of this invention. Further, each rotor 22 has a pair of tabs 38, which respectively engage a pair of flexible grounding contacts **28*a* and 28*b* (only a single pair of contacts 28 is shown with the rotor $22_{12}$ for clarity). Further, each rotor 22 has a first pair of spline cams 24*a* and 24*b* adapted to engage and expand that pair of cantilever contacts 16 disposed in one of the rows 12 and a second pair of spline cams 26*a* and 26*b*, which are oriented in a plane disposed at 90° from that plane extending through the cam splines 24*a* and 24*b*. The spline cams 26*a* and 26*b* engage and expand that pair of contacts 16 in one of the columns 14. The electrically conductive member 23 serves when disposed in its closing position, i.e., the rotor $22_{21}$ is disposed in its closing position, to complete the circuit 32 between its column 14 and its row 12. The cam splines 24*a* and 24*b* of the rotor $22_{11}$ are so rotated to engage the pair of cantilever contacts 16 in its row $12_1$, whereby they are disposed to their separated position. In a similar fashion, the cam splines 26*a* and 26*b* of the rotor $22_{11}$ engage its pair of cantilever contacts 16 as disposed in the column $14_1$, whereby that pair of cantilever contacts 16** are also disposed to their separated position.

Further, each rotor 22 includes a pair of cylindrically configured insulating members **30*a* and 30*b*. Each of the insulating members 30*a* and 30*b* has a pair of slots 36*a* and 36*b* for respectively receiving the cam spleens 24 or 26. It is understood that the spleens 24*a* and 24*b* (as well as the spleens 26*a* and 26*b*) are distinct, spaced, finger-like members and are received in their respective slots 36*a* and 36*b*. Further, a shaft 34*a* extends centrally from the insulating member 30*a* and is adapted, i.e., is slotted, to receive a knob, whereby the rotor 22 may be manually rotated. In a similar fashion, a shaft 34*b* is affixed to and extends from the insulating member 30*b* and is similarly adapted to receive either a switch, which may be used to control auxiliary transmitter circuits and/or provide switch position indication, or an appropriate motor, which may be remotely energized or actuated to rotate its rotor 22. Though not shown, there is provided a chassis comprising a center plate, a front mounting plate and a back mounting plate. The front and back mounting plates support bearings for respectively receiving the shafts 34*a* and 34*b*. The insulating members 30*a* and 30*b* serve to electrically insulate the rotor 22 from the front and back mounting plates, which form a part of the chassis of the switch array 10. In addition, an insulating member (not shown) is attached to each of the support members 20 and serves to support each of the support members 20 and its pair of cantilever contacts 16** with respect to the front mounting plate and the back mounting plate.

A pair of the grounding contacts **28*a* and 28*b* is associated with each of the rotors 22 to chassis ground the rotor 22 and, in particular, its electrically conductive member 23, when the rotor 22 is disposed in its through position. For example, rotor $22_{12}$ of FIG. 3 is disposed in its through position. As illustrated, the electrically conductive member 23 of the rotor $22_{12}$ is disposed at ground by the contacts 28. In particular, the electrically conductive member 23 has the pair of tabs 32, which are disposed in its through position to contact respectively the contacts 28*a* and 28*b*. In its through position, the spleens 24 and 26 do not engage their pairs of cantilever contacts 16. The contacts 28*a* and *b* dispose the rotor 22 and in particular its electrically conductive member 23 to chassis ground. If not so grounded in its through position, the electrically conductive member would serve to some degree to couple the RF signals as applied to the cantilever contacts 16 of each of the columns 14 to the contacts 16 of the rows 12. It is understood that the grounding contacts 28 ground the electrically conductive members 23 and further isolate the strip line of each of the columns 14 from the strip lines of each of the rows 12**.

In order to connect a particular one of the plurality of transmitters to a particular one of the plurality of antennas, a selected rotor 22 is rotated 90° from its through position. For example, as shown in FIG. 3, if it is desired to couple the transmitter connected at the top of the column $14_1$ of the strip line of switches S to that antenna a would be coupled to the right most end of the row $12_1$ (as shown in FIG. 3) of switches S, then the rotor $22_{11}$ is rotated 90°. The rotor $22_{11}$ is rotated to its closing position, wherein its spline cams **24*a* and 24*b* come into contact and deflect its pair of cantilever contacts 16 into their separated position, whereby the adjacent contact portions 16*b* of each of the separated cantilever contacts 16 are displaced from and electrical contact is broken with respect to the first ends 16*e* of the adjacent cantilever contacts 16, i.e., that pair of contacts 16 disposed immediately to the left of the separated contacts 16 in row $12_1$ as shown in FIG. 3. At the same time, the spline cams 26*a* and 26*b* of the rotor $22_{11}$ engage and separate its cantilever contacts 16 as disposed in the column $14_1$, whereby electrical contact with the next set of contacts in that column $14_1$, i.e., those contacts 16 shown immediately below the separated contacts in FIG. 3. Noting that the members 23 of each of the rotors 22 are made of an electrically conductive material, the member 23 of the rotor $22_{11}$ completes the circuit between the cantilever contacts 16 in the strip line of column $14_1$ through the member 23 to that set of cantilever contacts 16 disposed within the row $12_1$, as indicated by the current path 32**. It is appreciated that other of the switches S may be similarly actuated to couple other transmitters to selected other antennas.

As the frequency and peak power of the signal applied to the switch array 10 is increased, new demands are imposed upon the design of the array 10 and, in particular, the cantilever contacts 16 incorporated therein. For example, experience has shown that as the peak power exceeds approximately 400 kilowatts, that sufficient voltages are developed to cause corona or arcing problems. In particular, arcing between adjacent and separated cantilever contacts 16 or between the contacts 16 and the chassis may occur, thereby significantly affecting the transmission of signals, as well as physically damaging the array 10. In addition, as the frequency of the signal applied to the rows and columns of strip lines varies, the impedance as would be presented by one of the strip lines of switches S may vary. As a result, it is necessary to find some mechanism whereby that impedance as presented by a succession of the pairs of cantilever contacts 16 within a strip line may be controlled and adjusted to match the characteristic impedance of the transmission system which is coupled to the array of strip lines. Though not shown, such transmission system comprises the RF transmitter or signal generator, that coaxial cable which couples the transmitter to one of the rows 12, an antenna, and that coaxial cable which couples the antenna to one of the columns 14. As will be explained, the cantilever contact 16 of this invention has been configured to solve both of these problems.

Referring now to FIGS. 1 and 2, each cantilever contact 16 is configured to substantially prevent or reduce corona or arcing between adjacent cantilever contacts 16, even when high peak levels of power as high as 470 kilowatts and voltages as high as 4,950V are applied to the cantilever contacts 16. As illustrated in FIG. 3, arcing is a particular problem when the cantilever contacts 16 are disposed in their separated position. As shown in FIG. 3, those cantilever contacts 16 as associated with switch $S_{11}$ are disposed in their separated position. A relatively high voltage is imposed upon the second contact portion **16*b*, which may cause arcing and/or corona with respect to the pair of cantilever contacts 16, which are shown immediately to the left thereof in FIG. 3**.

The cantilever contacts 16 are configured to reduce corona and/or arcing between adjacent contacts 16 in a strip line. In particular, the first protective end **16*f* is of a greater length than the first contact portion 16*e* and extends at a right angle from the first contact portion 16*e* to form therewith an "L-shaped" member. As shown in FIG. 3, the affixed portions 16*d* are secured to opposing surfaces of the support block 20 so that the first protective ends 16*f* extend over a substantial part of the back surface of the block 20 to present a rounded surface to the adjacent set of cantilever contacts 16, thereby significantly reducing the potential arcing and/or corona between adjacent pairs of cantilever contacts 16 when one pair of the contacts 16 s disposed in its separated position. Further, the free protective end 16*a* is rounded with an illustrative radius of 0.03 inches, and the rounded portion folded back in a protective manner of the contact portion 16*b*, whereby no sharp edge is presented to the adjacent contact 16. In effect, the second protective end 16*a* and the first protective end 16*f* are so configured and so placed such that the leading edges of adjacent contacts are bent over upon themselves to increase the separation between and to shield effectively from each other the first protective end 16*f* and the second protective end 16*a* of adjacent contacts 16. Thus, the possibility of arcing and/or corona between adjacent separated cantilever contacts 16, i.e., when one pair of contacts 16** is disposed in its separated position, is reduced.

The cantilever contacts 16 are further designed to ensure that adjacent contacts 16 in a strip line make effective electrical contact with each other. The first contact portion **16*e*, as shown in FIG. 2, extends at an angle "b" of approximately 20° from the affixed portion 16*d*. The second contact portion 16*b*, as shown in FIG. 2, extends toward the first end and is disposed in the rest unflexed position of the cantilever lever 16 at an angle "a" of about 10°. with respect to the horizontal. It is understood that the second contact portion 16*b* is adapted to mate with and is spring biased by the spring portion 16*c* to mate with the first contact portion 16*e* of an adjacent cantilever contact 16. When the second contact portion 16*b* so engages the adjacent contact 16, the biasing force of the spring portion 16*c* flexes the second contact portion 16*b*, whereby it is disposed at a greater angle substantially equal to about 20° with respect to horizontal, whereby the second contact portion 16*b* is disposed in a substantially parallel relation with respect to the first contact portion 16*e***.

As particularly shown in FIG. 1, the cantilever contact 16 has a single, primary bifurcation **20*a* disposed centrally of and along most of the length of the contact 16, dividing it longitudinally into two parallel major portions 21*a* and 21*b*. The bifurcating slot 20*a* extends from the second end 16*a* towards the first end 16*e* along the extent of the spring portion 16*c* and into the affixed portion 16*d*. Further, each such parallel portion has further secondary bifurcations 20*b* and 20*c* disposed longitudinally of the cantilever contact 16 to divide the cantilever contact 16 at its free end 16*a* into four contact strips or fingers 23*a*, *b*, *c* and *d*. Each of the major portions 21*a* and 21*b* is of substantially equal width and, further, each of the fingers 23*a*, *b*, *c* and *d* is also of substantially equal width. The centrally disposed bifurcating slot 20*a* is of greater length than either of the secondary bifurcating slots 20*b* and 20*c* and primarily serves to add flexibility to the first and second major portions 21*a* and 21*b*. The lengths of the secondary bifurcating slots 20*b* and 20*c* are primarily dimensioned to maintain the rigidity of the fingers 23*a*, *b*, *c* and *d* and secondarily to set the impedance of each of the cantilever contacts 16 in its strip line. As a result, when a pair of cantilever contacts 16 are in their closing position, a significant pressure is developed by each cantilever contacts 16 such that each of its fingers 23*a*, *b*, *c* and *d* press their dimples 18 firmly against the first contact portion 16*e* of the adjacent cantilever contact 16. In this fashion, an effective, low-resistant contact is assured between adjacent cantilever contacts 16 and the life of the contacts 16** is extended.

In operation, the current flowing through the cantilever contact 16 is channeled first into two paths through the major positions **21*a* and *b*, and subsequently into four paths through the fingers 23*a*, *b*, *c* and *d*, whereby the inductance presented by each cantilever contact 16 is increased as a second order effect. The increased inductance presented by a cantilever contact 16 of this configuration compensates to some degree the high capacitance of this type of contact, whereby a strip line as comprised of a sequence of the pairs of such cantilever contacts 16 will act as a carrier line. In an illustrative embodiment of this invention, where the array 10 is adapted to be coupled to a plurality of transmitters, each cantilever contact 16 of a particular line strip and, in particular, the length and width of slots 20*b* and 20*c* are dimensioned to set the impedance of that cantilever contact 16, as well as the impedances of the other, like cantilever contacts 16 in that strip line, so that the composite impedance presented by the strip line matches the characteristic impedance of the transmission system, and the energy loss due to a mismatch of impedances is significantly reduced. In an illustrative embodiment of this invention, each of the cantilever contacts 16 have a longitudinal length of 4.235 inches, whereas the centrally disposed slot 20*a*** has a length of 3.540 inches and a width of 0.062 inch, and each of the secondary slots 20*b* and 20*c* has a longitudinal length of 1.044 inches and a width of 0.031 inch. Further, the widths of each of the fingers 23*a, b, c* and *d* are equal and thus present equal inductances to the current flows therethrough, whereby substantially equal currents flow longitudinally through each of the fingers 23 of the contact 16. It is appreciated that significant current flows through each of the cantilever contacts 16, which causes the contacts 16 to be heated typically to over 100° C. Higher temperatures may affect the temper and, thus, the flexibility of the cantilever contacts 16, whereby their life may be shortened. By making each of the fingers 23*a, b, c* and *d* of equal width and assuring that equal currents flow through each of the fingers 23, provision is made to prevent one part or finger 23 of a contact 16 from being heated to a significantly higher temperature than the other parts or fingers 23 of the cantilever contact 16. As a result, the flexibility and temper of each of the fingers 23 is prolonged, whereby contact between adjacent cantilever contacts 16 is ensured and the average power rating of the switch array 10 increased.

As particularly shown in FIGS. 1 and 2, each of the contact strips 23*a, b, c* and d carries its own hemispherical contact point or dimple 18*a, b, c* and *d*, respectively. Each dimple 18 is disposed in proximity to its free end 16*a* and serves to physically contact the contact portion 16*b* of one contact 16 to the first end 16*e* of an adjacent cantilever contact 16 in the strip line. The multiple bifurcations 20*a, b* and *c* contribute to greater contact flexibility, and assure the positive contact between successive pairs of contacts.

In considering this invention, it should remembered that the present disclosure is illustrative only and the scope of the invention should be determined by the appended claims.

I claim:

1. A contact to be incorporated into a switch system comprising a strip line, which includes a plurality of like contacts arranged in an end-to-end, overlapping relation with each other, said strip line of contacts having one end adapted to be connected to a signal transmission system, said signal transmission system having a characteristic impedance, each contact in said strip line mounted upon a support member, each contact having first and second ends and comprising:

(a) a first portion adjacent said first end affixed to said support member;

(b) a second spring portion disposed intermediate said first and second ends;

(c) a third contact portion disposed adjacent to said first fixed portion and on the other side of said first fixed portion with respect to said second spring portion;

(d) a fourth contact portion disposed adjacent said second end and freely suspended by said second spring portion with respect to said support member for contacting a third contact portion of an adjacent contact in said strip line of contacts; and (e) said contact having a bifurcating slot disposed longitudinally thereof and extending from said second end towards said first end for providing fingers, said bifurcating slot being of such dimension that said strip line of like contacts provides an impedance set substantially equal to said characteristic impedance.

2. The contact as claimed in claim 1, wherein there is included a second bifurcating slot disposed centrally of said contact to enhance the flexibility of the resulting bifurcated portions.

3. The contact as claimed in claim 2, wherein said first mentioned and a third bifurcating slots are disposed on either side of said second bifurcating slot to thereby form first, second, third and fourth fingers, said first mentioned and said third bifurcating slots extending from said second end towards said first end.

4. The contact as claimed 3, wherein the dimensions of said first mentioned and said third bifurcating slots are set such that said line of like contacts provide an impedance set substantially equal to said characteristic impedance.

5. The contact as claimed in claim 4, wherein said second bifurcating slot is centrally disposed and has a length in excess of that of said first mentioned and third bifurcating slots.

6. The contact as claimed in claim 4, wherein each of said first, second, third and fourth fingers is of substantially equal width, whereby substantially equal currents flow longitudinally therethrough.

7. A contact to be incorporated into a switch system comprising a strip line comprising, which includes a plurality of like contacts arranged in an end-to-end, overlapping relation with each other, said strip line of contacts having one end adapted to be connected to a signal transmission system, each contact of said strip line mounted on a support member, each contact having first and second ends and comprising:

(a) a first portion disposed adjacent said first end and affixed to said support member;

(b) a second spring portion disposed intermediate said first and second ends;

(c) a third contact portion disposed adjacent to said first fixed portion and on the other side of first fixed portion with respect to said second spring portion;

(d) a fourth contact portion disposed adjacent said second end and suspended freely by said second spring portion with respect to said support member for contacting a third contact portion of an adjacent contact in said strip line of contacts; and (e) said contact having a first bifurcating slot disposed longitudinally thereof and extending a first length from said second end towards said first end for providing at least first and second fingers, and a second bifurcating slot disposed longitudinally thereof and extending a second length from said second end towards said first end, said second length being greater than said first length, whereby said second bifurcating slot provides longitudinal flexibility to said contact, and said first and second fingers have sufficient rigidity to ensure that said fourth contact portion mates with sufficient pressure against said third contact portion of said adjacent contact to effect an efficient electrical contact between said contact and said adjacent contact.

8. The contact as claimed in claim 7, wherein there is further included a third bifurcating slot disposed longitudinally of said contact and extending from said second end towards said first end for providing third and fourth fingers, said third bifurcating slot disposed on the other side of said second bifurcating slot with respect to said first bifurcating slot.

9. The contact as claimed in claim 8, wherein said third bifurcating slot has a third length substantially equal to said first length.

10. The contact as claimed in 8, wherein each of said first, second, third and fourth fingers is of substantially equal width, whereby substantially equal currents flow longitudinally therethrough.

11. A switch system adapted to be connected to a signal transmission system, said switch system comprising:

(a) a strip line comprising a plurality of like contacts, and a support member for each of said plurality of like contacts;

(b) each of said contacts disposable from a closed position to a separated position and comprising:

(1) a first trailing end and a second leading end, (2) a first portion affixed to its support member, (3) a second spring portion disposed intermediate said first affixed portion and said second leading end, (4) a third contact portion disposed adjacent to said first fixed portion and o the other side of said first fixed portion with respect to said second spring portion, (5) a fourth contact portion freely suspended by said second spring portion with respect to its support member, said fourth contact portion of on of said plurality of contacts in said strip line being disposable in contact with a third contact portion of an adjacent contact in said strip line when said one contact is in its closed position, said fourth contact portion of said one contact being disposable remotely of said third contact portion of said adjacent contact when said one contact is in its separated position, and (6) fifth and sixth protective portions disposed respectively adjacent said first trailing end and said second leading end, and extending respectively from said third contact portion and said fourth contact portion;

(c) said support members supporting their respective contacts to lie in an end-to-end, overlapping relation with each other, whereby said fourth contact portion of said one contact mates with said third contact portion of said adjacent contact, when said one contact is disposed in its closing position;

(d) said fifth and sixth protective portions being folded back respectively upon said third contact portion and said fourth contact portion, whereby when said one contact is in its separated position, its second leading end is shielded by its sixth protective portion from said first trailing end of said adjacent contact and said first trailing end of said adjacent contact is shielded by its fifth protective portion from said second leading end of said one contact so that arcing and corona between said on and said adjacent contacts in said strip line are reduced.

12. The switch system as claimed in claim 11, wherein said third contact portion is disposed at an angle of approximately 20°. with respect to said first fixed portion and said fifth protective portion extends at an angle of approximately 90°. with respect to said third contact portion.

13. The switch system as claimed in claim 12, wherein said fourth contact portion is disposed at an angle of approximately 10° with respect to said first fixed portion and said sixth protective portion extends from said fourth contact portion and is of a U-shaped configuration.

14. The switch system as claimed in claim 11, wherein each of said first-mentioned plurality of contacts is secured to a surface of its support member, and there is further included a second plurality of contacts, each of said second plurality of contacts is mounted upon an opposing surface of its support member to lie in a substantially parallel relationship to its corresponding contact of said first plurality.

* * * * *